United States Patent [19]

Thomas

[11] 4,375,890

[45] Mar. 8, 1983

[54] TETHERED PROJECTILE GAME DEVICE

[76] Inventor: Spencer Thomas, 3628 Goode, Montgomery, Ala. 36105

[21] Appl. No.: 188,550

[22] Filed: Sep. 18, 1980

[51] Int. Cl.[3] ..... A63B 67/10

[52] U.S. Cl. ..... 273/320

[58] Field of Search ..... 273/320, 321, 319, 323, 273/329, 330, 331, 332, 333, 334, 335, 342, 398, 400, 401, 413, 414, 109, 113, 115, 123 R, 324

[56] References Cited

U.S. PATENT DOCUMENTS

| | | | |
|---|---|---|---|
| 290,328 | 12/1883 | Hicks | 273/320 |
| 614,542 | 11/1898 | Gatward | 273/320 |
| 1,206,718 | 11/1916 | Kohler | 273/115 |
| 1,578,892 | 3/1926 | Holman | 273/118 R |
| 2,181,236 | 11/1939 | Irwin | 273/320 |
| 2,196,253 | 4/1940 | Di Bella | 273/320 |
| 2,246,897 | 6/1941 | Rodriguez | 273/321 |
| 2,465,808 | 3/1949 | Killam | 273/324 |
| 2,512,239 | 10/1946 | Singer | 273/321 |
| 2,835,494 | 5/1958 | Hull | 273/324 |
| 2,999,692 | 9/1961 | Di Pietro | 273/320 |
| 3,087,730 | 4/1963 | Buckner | 273/320 |
| 3,494,618 | 2/1970 | Kramer | 273/320 |
| 3,737,164 | 6/1973 | De Yoe, Jr. | 273/329 |
| 3,770,272 | 11/1973 | Olivier | 273/246 |
| 4,039,186 | 8/1977 | Anderson | 273/329 X |

FOREIGN PATENT DOCUMENTS

| | | | |
|---|---|---|---|
| 923538 | 2/1947 | France | 273/320 |
| 559008 | 1/1944 | United Kingdom | 273/298 |

*Primary Examiner*—William H. Grieb

*Attorney, Agent, or Firm*—Schuyler, Banner, Birch, McKie & Beckett

[57] ABSTRACT

A game device (10) is disclosed. A device (10) includes a base plate (16) through which a plurality of apertures (28) are formed. A ball (22) is tethered below the base plate (16) by a cord (24). A handle (18, 20) is disposed at either longitudinal end of the base plate (16). The length of the base plate (16) is selected so that each handle (18, 20) can be held by one of the hands of one person. A deck of cards (34), with assigned numerical values, is used to determine the number of turns a player has to swing the ball (22) into the apertures (28). The apertures (28) are assigned numerical scoring values.

18 Claims, 5 Drawing Figures

TETHERED PROJECTILE GAME DEVICE

TECHNICAL FIELD

The present invention relates to a tetherball game device.

BACKGROUND OF THE INVENTION

Numerous types of tetherball game devices have been used in the past. One type of prior art device uses a projectile or ball tethered to a paddle or plate. A plurality of apertures are formed through the paddle or plate and a handle is provided for gripping the paddle or plate with one hand. These devices have been designed to be operated by one hand and, hence, are limited to developing dexterity and coordination of a single hand used individually. Examples of this type of prior art device are seen in U.S. Pat. Nos. 290,328; 2,196,253; 2,512,239; 2,999,692; 3,087,730 and 4,039,186.

Another type of tetherball device is designed for simultaneous use by two persons. This type of device is shown in U.S. Pat. No. 3,494,618. The device shown in the U.S. Pat. No. 3,494,618 patent is comprised of a long rod adapted to be gripped at opposite ends by the individual players. An apertured plate extends transversely from the center of the rod and has a plurality of holes for receiving a tethered ball.

SUMMARY OF THE INVENTION

The present invention is directed to a game device. The device includes a projectile, an elongated base plate and a flexible cord connecting the projectile to the base plate. A plurality of projectile receiving pockets are formed at spaced locations along the length of the base plate and are shaped to receive the projectile. A handle is disposed at each longitudinal end of the base plate. The base plate has a length such that each handle can be gripped by a separate hand of one person. The cord has a length such that the projectile can be placed in any of the pockets. In use, the person holds one of the handles with each of his hands and manipulates the base plate to swing the projectile by the cord so that it is caught in one of the receiving pockets.

In a preferred embodiment, a wall extends upward from the front longitudinal edge of the plate and a back wall extends upward from the rear longitudinal edge of the plate. A plurality of ridges or ledges are disposed between most adjacent pockets. The projectile is preferably a ball and the pockets are preferably formed as holes through the base plate with the diameter of the holes being slightly less than the diameter of the ball.

Numerical values are preferably assigned to each of the holes and the device is preferably used with a plurality of numbered cards. Each of the cards is assigned a numerical value. A player chooses a card to determine the number of turns he will have to swing the ball into the holes. The numerical value assigned to each hole represents the number of points a player receives by swinging the ball into a respective hole. The player scoring the highest number of points wins the game. By forming the device such that it is held with the two hands of one person, dexterity and coordination of both hands and both arms are challenged. Also an element of chance is incorporated into the game by utilizing the deck of cards having various numbers representing turns assigned to them.

Various advantageous and features of novelty which characterize the invention are pointed out with particularity in the claims next annexed hereto and forming a part hereof. However, for a better understanding of the invention, its advantages and objects obtain by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
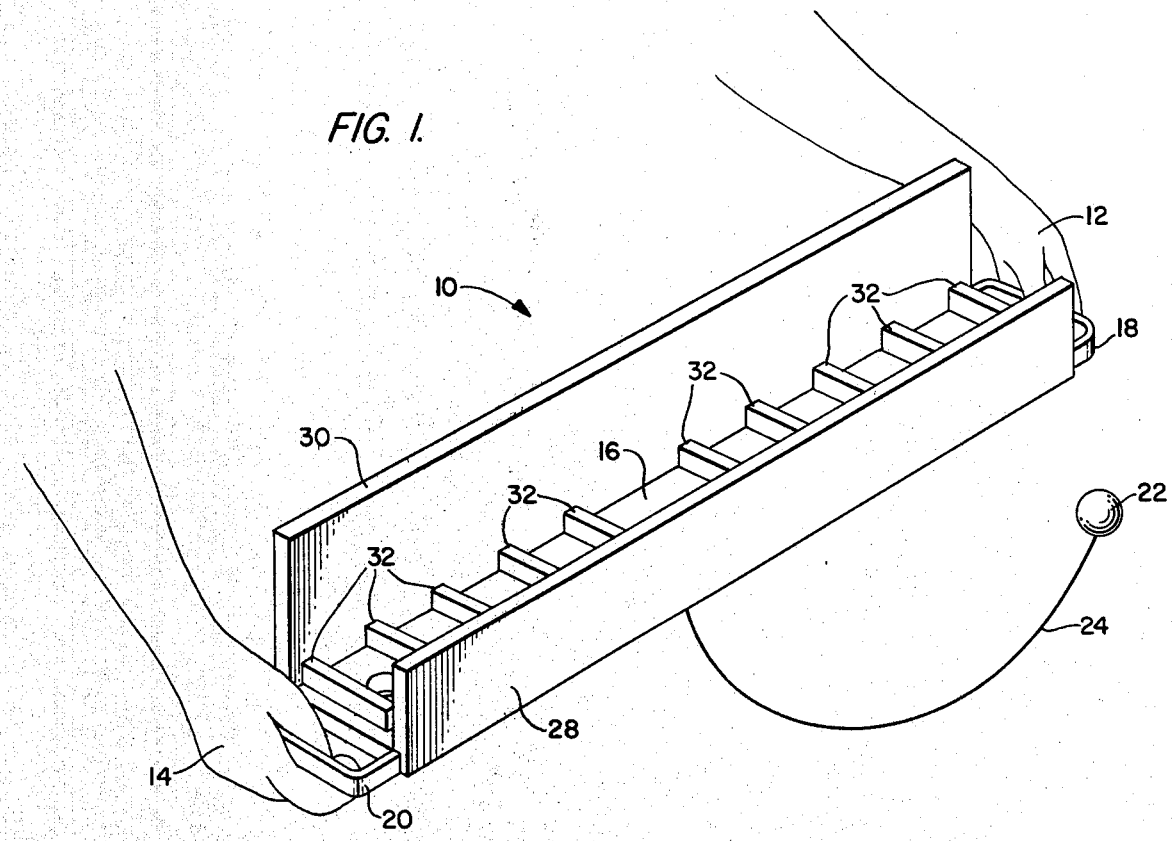
FIG. 1 is a perspective view of a game device in accordance with the present invention held by two hands of one player.

Referring to the drawings in detail, wherein like numerals indicate like elements, there is shown in FIG. 1 a game device designated generally as 10. The device 10 is shown in FIG. 1 held by the left and right hands 12, 14 of a single individual.

The apparatus 10 includes an elongate base plate 16. A handle 18 extends laterally outward from one longitudinal end of the plate 16 and a second handle 20 extends laterally outward from the opposite longitudinal end of the plate 16.

Figure 5:
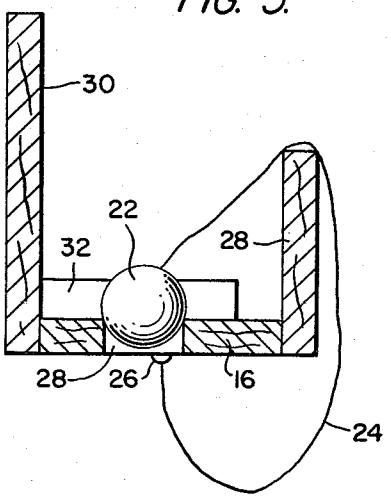
FIG. 5 is a sectional view taken generally along line 5—5 illustrating the ball received within one of the holes.

A projectile in the form of a ball 22 is connected or tethered to the bottom of the base plate 16 by means of a flexible cord 24 attached to the bottom of base plate 16 by a fastener 26. A plurality of ball receiving pockets in the form of apertures or holes 28 are formed in the base plate 16. The apertures 28 are disposed along substantially the entire length of plate 16. Each aperture 28 has a diameter slightly less than the diameter of the ball 22. The ball 22 thus can rest within any of the apertures 28. See FIG. 5. The length of the cord 24 is such that the ball 22 may be swung into any of the apertures 28 along the length of the plate 16.

A front wall 29 is attached to and extends upwardly from a front longitudinal edge of the base plate 16. A back wall 30 is attached to and extends upwardly from a rear longitudinal edge of the base plate 16 and can serve as a back stop. The back wall 30 is higher than the front wall 29. A plurality of raised divider ridges 32 are attached to the top surface of base plate 16. Each divider ridge 32 abuts an inner surface of the back wall 30, extends forwardly therefrom along the top surface of the base plate 16 and stops a short distance before the inner surface of front wall 29. A divider ridge 32 is disposed on either side of each of the apertures 28, except for the centermost pair of apertures 28. A divider ridge 32 is not disposed between the centermost pair of apertures 28, but rather only on the outside of the centermost pair of apertures 28.

Figure 2:
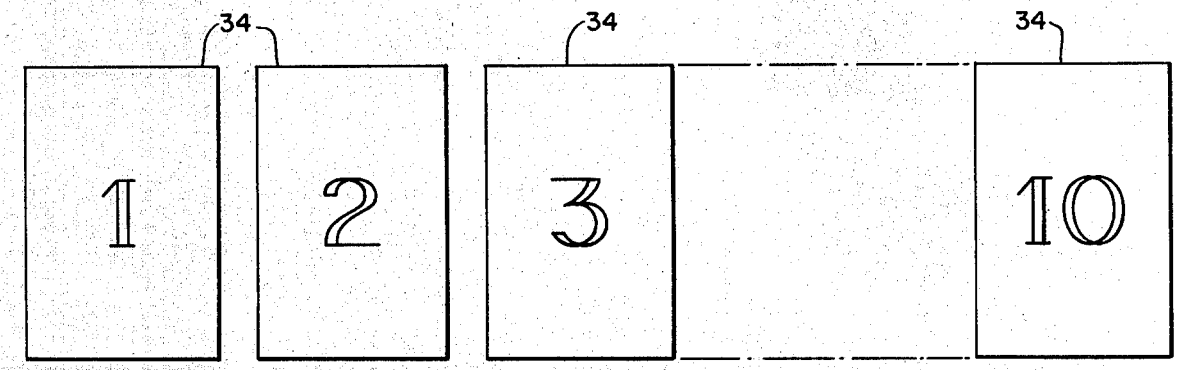
FIG. 2 is a schematic plan view of cards used in the present invention.
Figure 3:
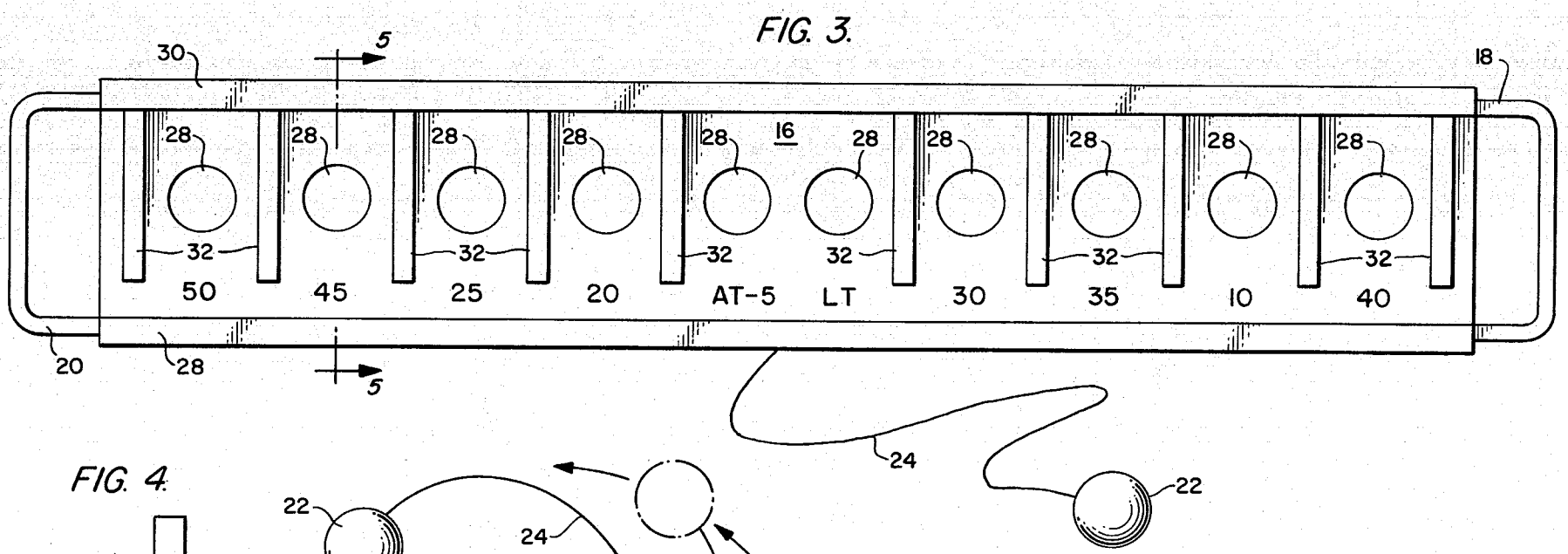
FIG. 3 is a top plan view of the game device.
Figure 4:
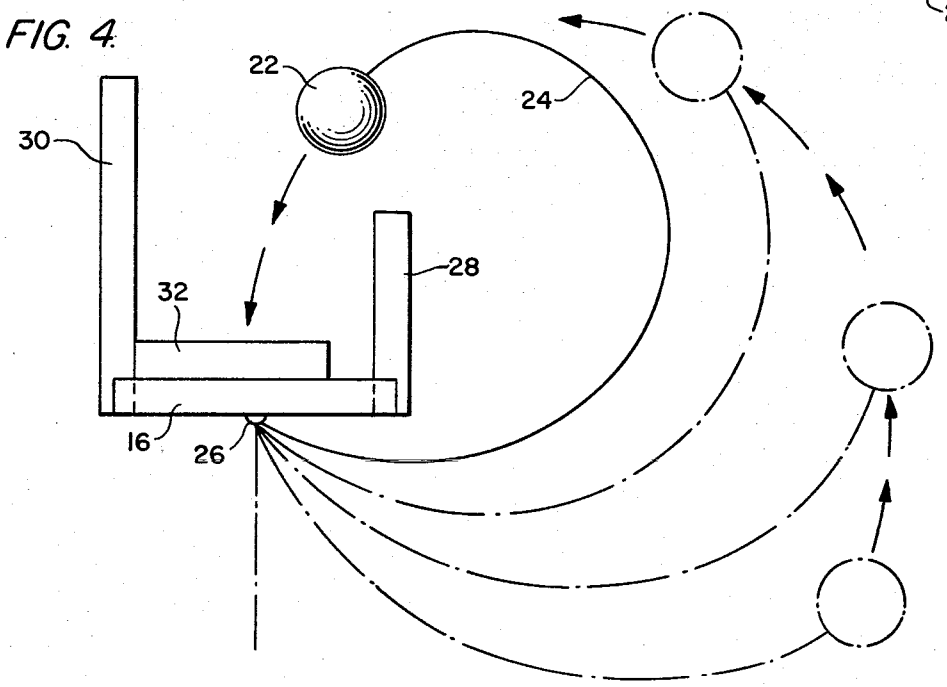
FIG. 4 is a side elevational view illustrating a ball being swung into the device.

As seen in FIG. 3, numerical point values are given to each of the apertures 28. As the ball 32 is swung into one of the apertures 28, a score equal to the assigned numerical value is given to the player. One of the centermost apertures 28 is assigned a lose turn indicia, wherein a player landing a ball 22 in this aperture 28 loses a turn. The other of the centermost apertures 28 is assigned indicia for another turn plus 5 points. A player landing a ball 22 in this aperture 28 receives another turn and 5 points. To add an additional element of chance to a game played with the device 10, the device 10 includes a deck of cards seen schematically in FIG. 2. Each card 34 is assigned a numerical value between one and ten. The deck of cards 34 preferably includes 50 cards with five cards each having one of the numbers between one and ten. The deck thus includes five cards with the number one, five cards with the number 2, etc.

A preferred game, using the device 10, is played in the following manner. Each player receives one or more cards 34. The number indicated on the card 34 is the number of turns the player gets to swing the ball 22 into one of the apertures 28. Each player plays one card 34 at a time. Each player totals the points he receives each time the ball 22 is swung into one of the apertures 28. As mentioned above, the two centermost apertures 28 indicate a loss of turn and the gaining of another turn. Play continues for as long as the players have cards 34 and turns indicated on the cards 34. The number of cards each player will receive is determined in advance of the deal. The player with the highest total of scored points wins.

The device 10 is designed to held by two hands of one person and the length of the base plate 16 is so selected. Generally, the length will be between one and two and a half feet. Coordination of both hands, arms and shoulders is thus required to pivot or swing the ball 22 into the apertures 28. Also, the length of the cord 24 is selected so that the ball 22 can be swung into any of the apertures 28 along the length of base plate 16.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in areas of shape, size and arrangement of parts, within the principle of the invention, to the full extent by the broad general meaning of the terms in which the appended claims are expressed.

I claim:

1. A game device comprising:

a projectile;

an elongate base plate, a plurality of projectile receiving pockets formed at spaced locations along the length of said base plate and shaped to receive said projectile;

a divider ridge disposed on either side of a majority of said projectile receiving pockets;

a flexible cord connecting said projectile to said device whereby said projectile can hang freely downward from said device;

a handle disposed at each longitudinal end of said base plate;

said base plate having such a length, and said handles being so constructed, that each handle can be simultaneously gripped by a separate hand of one person to dispose the lengthwise dimension of said device between the left and right hands of the one person, and said flexible cord having a length sufficient so that said projectile can be placed in any one of said projectile receiving pockets whereby the one person simultaneously gripping both of said handles can attempt to manipulate said base plate and swing said projectile upward from its freely hanging position and generally away from the lengthwise dimension of said device into one of said projectile receiving pockets by the motion.

2. A game device in accordance with claim 1, wherein a front wall extends upwardly from the front edge of said base plate along substantially its entire length.

3. A game device in accordance with claim 2, wherein a back wall extends upwardly from the back edge of said base plate along substantially its entire length.

4. A game device in accordance with claim 3, wherein said back wall has a height greater than said front wall.

5. A game device in accordance with claim 1, wherein the height of each of the divider ridges is less than the height of the front wall.

6. A game device in accordance with claim 1, wherein a scoring value is assigned to each of the projectile receiving pockets whereby a score is obtained by swinging said projectile into one of said pockets.

7. A game device in accordance with claim 6, including a plurality of cards, each card having a numerical value assigned to it, the numerical value of said cards determining the number of attempts a player has to swing the projectile into said pockets.

8. A game device in accordance with claim 7, wherein one of the centermost pockets is assigned a lose turn value and the other of said centermost pair of pockets is assigned another turn value.

9. A game device in accordance with claim 1, wherein said projectile is comprised of a ball and each of said pockets is formed as a hole through said base plate, each of said holes having a diameter slightly less than the diameter of said ball.

10. A game device in accordance with claim 1 wherein the length of said base plate is between approximately one foot and two and a half feet, and one of said handles extends laterally outward from each longitudinal end of said base plate.

11. A game device comprising:

a projectile;

an elongate base plate, a plurality of projectile receiving pockets formed at spaced intervals along the length of said base plate and shaped to receive said projectile;

a flexible cord connecting said projectile to said device whereby said projectile can hang freely downward from said device;

a handle disposed at each longitudinal end of said base plate;

a divider ridge disposed on both sides of each of said pockets except the centermost pair of pockets, a divider ridge being disposed on each laterally outer side of the centermost pair of pockets but not between the centermost pair of pockets;

said base plate having such a length, and said handles being so constructed, that each handle can be simultaneously gripped by a separate hand of one person to dispose the lengthwise dimension of said device between the left and right hands of the one person, and said flexible cord having a length sufficient so that said projectile can be placed in any one of said projectile receiving pockets whereby the one person simultaneously gripping both of said handles can attempt to manipulate said base plate and swing said projectile upward from its freely hanging position and generally away from the lengthwise dimension of said device into one of said projectile receiving pockets by the motion;

each of said projectile receiving pockets being assigned a scoring value whereby a score is obtained by swinging said projectile into one of said pockets.

12. A game device in accordance with claim 11 wherein a front wall extends upwardly from the front edge of said base plate along substantially its entire length.

13. A game device in accordance with claim 12 wherein a back wall extends upwardly from the back edge of said base plate along substantially its entire length.

14. A game device comprising:

a projectile;

an elongated base plate, a plurality of projectile receiving pockets formed at spaced locations along substantially the entire length of said base plate and shaped to receive said projectile, each of said projectile receiving pockets having an assigned scoring value;

a flexible cord connecting said projectile to said device whereby said projectile can hang freely downward from said device;

a front wall extending upwardly from the front edge of said base plate along substantially its entire length;

a back wall extending upwardly from the back edge of said base plate along substantially its entire length;

a handle extending laterally outward from each longitudinal end of said base plate;

said base plate having such a length, and said handles being so constructed, that each handle can be simultaneously gripped by a separate hand of one person to dispose the lengthwise dimension of said device between the left and right hands of the one person, and said flexible cord having a length sufficient so that said projectile can be placed in any one of said projectile receiving pockets whereby the one person simultaneously gripping each of said handles can attempt to manipulate said base plate and swing said projectile upward from its freely hanging position and generally away from the lengthwise dimension of said device into one of said projectile receiving pockets by the motion to obtain the score of the projectile receiving pocket into which it is swung, and a plurality of cards, each card having a numerical value assigned to it, the numerical value of said card determining the number of attempts a player has to swing the projectile into said pockets.

15. A game device in accordance with claim 14 wherein the length of said base plate is between approximately one foot and two and one-half feet.

16. A game device in accordance with claim 14 including a plurality of divider ridges disposed on either side of a majority of said projectile receiving pockets.

17. A game device comprising:

a ball;

an elongate base plate, a plurality of ball receiving holes formed through said base plate at spaced locations along substantially the entire length of said base plate, each of said holes having a diameter slightly less than the diameter of said ball;

a flexible cord connecting said ball to said base plate whereby said ball can hang freely downward from said base plate;

a handle disposed at each longitudinal end of said base plate;

a front wall extending upwardly from the front edge of said base plate along substantially its entire length;

a back up wall extending upwardly from the back edge of said base plate along substantially its entire length;

a divider ridge disposed on either side of a majority of said holes, the height of each divider ridge being less than the height of said front wall;

a scoring value assigned to each of the holes whereby a score is obtained by swinging the ball into one of said holes;

a plurality of cards, each card having a numerical value assigned to it, the numerical value of said cards determining the number of attempts the player has to swing the ball into said holes;

said base plate having such a length, and said handles being so constructed, that each handle can be simultaneously gripped by a separate hand of one person to dispose the lengthwise dimension of said device between the left and right hands of the one person, and said flexible cord having a length sufficient so that said ball can be placed in any one of said holes whereby the one person simultaneously gripping both of said handles can attempt to manipulate said base plate and swing said ball upward from its free hanging position and generally away from the lengthwise dimension of said device into one of said holes by the motion.

18. A game device comprising:

a projectile;

an elongated base plate, a plurality of projectile receiving pockets formed at spaced locations along substantially the entire length of said base plate and shaped to receive said projectile, each of said projectile receiving pockets having an assigned scoring value;

a flexible cord connecting said projectile to said device whereby said projectile can hang freely downward from said device;

a front wall extending upwardly from the front edge of said base plate along substantially its entire length;

a back wall extending upwardly from the back edge of said base plate along substantially its entire length;

a handle extending laterally outward from each longitudinal end of said base plate;

said base plate having such a length, and said handles being so constructed that each handle can be simultaneously gripped by a separate hand of one person to dispose the lengthwise dimension of said device between the left and right hands of the one person, and said flexible cord having a length sufficient so that said projectile can be placed in any one of said projectile receiving pockets whereby the one person simultaneously gripping each of said handles can attempt to manipulate said base plate and swing said projectile upward from its freely hanging position and generally away from the lengthwise dimension of said device into one of said projectile receiving pockets by the motion to obtain the score of the projectile receiving pocket into which it is swung; and a plurality of divider ridges disposed on either side of a majority of said projectile receiving pockets.

* * * * *